US009523196B2

(12) United States Patent
Rice

(10) Patent No.: US 9,523,196 B2
(45) Date of Patent: Dec. 20, 2016

(54) BRACKET FOR BRIDGING MEMBER FOR METAL STUD WALL

(71) Applicant: Bailey Metal Products Limited, Concord (CA)

(72) Inventor: John Rice, Napanee (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 14/845,788

(22) Filed: Sep. 4, 2015

(65) Prior Publication Data

US 2016/0069072 A1 Mar. 10, 2016

Related U.S. Application Data

(60) Provisional application No. 62/045,992, filed on Sep. 4, 2014.

(51) Int. Cl.

| | |
|---|---|
| ***E04B 2/62*** | (2006.01) |
| ***E04B 2/72*** | (2006.01) |
| ***E04B 2/76*** | (2006.01) |
| ***E04B 2/78*** | (2006.01) |
| ***E04C 3/09*** | (2006.01) |
| *E04C 3/04* | (2006.01) |

(52) U.S. Cl.

CPC ..... *E04B 2/62* (2013.01); *E04B 2/721* (2013.01); *E04B 2/761* (2013.01); *E04B 2/762* (2013.01); *E04B 2/763* (2013.01); *E04C 3/09* (2013.01); *E04B 2/789* (2013.01); *E04C 2003/0473* (2013.01)

(58) Field of Classification Search

CPC ..... E04B 2/761; E04B 2/762; E04B 2/763; E04B 2001/2415

USPC ..... 52/241, 317, 93.1, 92.2, 665

See application file for complete search history.

(56) References Cited

U.S. PATENT DOCUMENTS

| | | | | | |
|---|---|---|---|---|---|
| 2,480,805 | A * | 8/1949 | Buckels | H02G 3/125 | 174/503 |
| 3,113,358 | A * | 12/1963 | Zell | F16B 12/20 | 248/221.11 |
| 3,343,329 | A * | 9/1967 | Pohutsky | E04B 9/22 | 165/49 |
| 3,831,338 | A * | 8/1974 | Klingensmith | F16B 7/00 | 403/231 |
| 3,854,192 | A * | 12/1974 | O'Konski | B23K 37/04 | 228/135 |

(Continued)

*Primary Examiner* — Robert Canfield

(57) ABSTRACT

A bracket for attaching bridging members to a thermal stud being generally C-shaped with parallel spaced apart flanges connected by a central web having opening in the web of the stud which spans the majority of the width of the web and where the openings are provided with flanges extending perpendicularly from the edges of the opening into the interior of the stud. The bracket is a generally L-shaped bracket having a leg with a means to properly locate a bridging member centrally within the bracket and the stud wall and a base for overlying the web of the stud. The base has a width approximately the same as the stud and preferably has flanges extending perpendicularly from the base at either end thereof to engage and be able to attach to the flanges of the stud. The base is also provided with a centrally located tab extending perpendicularly from the base to allow the bracket to be properly positioned within the web of the stud.

6 Claims, 6 Drawing Sheets

(56) References Cited

U.S. PATENT DOCUMENTS 3,902,298 A * 9/1975 Ratliff, Jr. ..... E04B 1/2612 403/188
4,610,562 A * 9/1986 Dunn ..... E04B 9/18 403/191
4,693,047 A * 9/1987 Menchetti ..... E04B 2/763 52/241
4,753,053 A * 6/1988 Heard ..... F27D 1/141 110/336
5,544,866 A * 8/1996 Dye ..... E04F 11/1836 256/59
5,619,836 A * 4/1997 Rouch ..... E04G 23/0203 411/458
5,642,597 A * 7/1997 Hendrickson ..... E04B 2/7457 52/489.1
5,664,392 A * 9/1997 Mucha ..... E04B 2/96 248/262
5,906,080 A * 5/1999 diGirolamo ..... E04B 2/7453 411/546
5,943,838 A * 8/1999 Madsen ..... E04B 2/7457 52/481.1
6,213,679 B1 * 4/2001 Frobosilo ..... E04B 2/82 403/14
6,293,061 B1 * 9/2001 Horak, Jr. ..... E06B 1/6015 52/213
6,578,335 B2 * 6/2003 Poliquin ..... E04B 2/58 248/297.21
6,739,562 B2 * 5/2004 Rice ..... E04B 2/7457 248/247
D649,016 S * 11/2011 Rasmussen ..... D8/354
8,181,419 B1 * 5/2012 diGirolamo ..... E04B 2/768 248/909
8,333,359 B2 * 12/2012 Gordon ..... E06B 1/6015 248/223.21
8,407,947 B2 * 4/2013 Yaggi, Jr. ..... E04D 12/006 248/300
RE45,355 E * 2/2015 Root ..... E06B 1/6015 49/380
9,016,024 B1 * 4/2015 Daudet ..... E04B 2/763 52/643
9,091,056 B2 * 7/2015 Stauffer ..... E04B 1/40
2002/0046525 A1 * 4/2002 Rice ..... E04B 2/7457 52/481.1
2002/0062617 A1 * 5/2002 diGirolamo ..... E04B 2/767 52/688
2006/0032180 A1 * 2/2006 Peterson ..... E04B 2/96 52/712
2006/0185311 A1 * 8/2006 Attalla ..... E04B 7/045 52/639
2006/0191236 A1 * 8/2006 Surowiecki ..... E04B 2/763 52/481.1
2007/0199274 A1 * 8/2007 Rice ..... E04B 2/763 52/712
2007/0251186 A1 * 11/2007 Rice ..... E04B 2/7457 52/483.1
2008/0053034 A1 * 3/2008 Matechuk ..... E04B 1/24 52/702
2008/0078894 A1 * 4/2008 Morrow ..... E04B 1/003 248/200

* cited by examiner

BRACKET FOR BRIDGING MEMBER FOR METAL STUD WALL

FIELD OF THE INVENTION

The present invention relates to a bracket for attaching bridging members to the studs of a metal stud wall. In particular, the present invention relates to a bracket which is utilized to attach bridging members to studs having enlarged openings for thermal break to provide for the proper support of the bridging members for the studs in the stud wall.

BACKGROUND OF THE INVENTION

Metal studs for use in constructing partition walls are becoming more prevalent. The metal studs of a generally C-shaped cross-section are utilized in a manner similar to wooden studs for constructing partition walls. Metal studs are typically arranged vertically and tied together at the top and bottom by U-shaped channel members which act as top and bottom tracks for the stud wall. Stud walls which are subjected to wind and/or axial loads such as is found if the stud wall forms the exterior wall or as a load bearing wall require lateral support to provide resistance to rotation and minor axis bending under wind and axial loads.

The lateral support for the metal stud walls is generally provided by installing bridging members which tie the metal studs together at points intermediate the ends of the studs. These bridging members are typically U-shaped metal internal bridging members installed through openings provided in the web of the metal stud. In order to transfer the support provided by the internal bridging members to the metal studs, the bridging members are physically tied to the metal studs. In most installations L-shaped brackets are provided to transfer the support provided by the interior bridging members to the edges of the metal studs. These L-shaped brackets are attached to the metal stud and bridging member with the leg of the bracket being fastened to the interior bridging member and the base or upright of the L-shaped bracket being attached to the metal stud.

In many such studs, the web of the stud is provided with an opening having a width approximately the same as the width of the bridging member. The provision of the openings aligns and holds the bridging members securely in position and provides for a significant amount of material in the web of the stud to either side of the opening to allow for attachment of the L-shaped brackets.

One drawback of metal studs is the thermal conductivity which the metal provides as compared to wood studs. This is particularly an issue in colder climates where the metal studs are utilized in an exterior wall such that the metal stud can conduct colder temperatures through the wall and into the interior of the space. There have been a number of designs of metal stud developed to aid in breaking this thermal conductivity and one of the most common of these designs is known as the Thermo Stud.™ Such studs were developed by Ernest Bogner and are shown for example in Canadian Patent 1,324,872 issued Dec. 7, 1993 and Canadian Patent 2,404,320 issued Feb. 8, 2005 among others.

In these Canadian Patents it was described that the studs are provided with openings through the web at spaced intervals therein wherein at least a side portion of the web removed from the opening remains integrally attached to the web such that the material is bent from the web perpendicular to the web to provide for reinforcing of the web while also providing a significant opening to reduce thermal transfer through the web. As the openings in the web traverse a significant portion of the width of the web, there is both no provision in the openings or in the web to each side of the openings to provide for the support necessary for the bridging member to be properly placed. There thus remains a need for a means for properly aligning and attaching the bridging member to such studs.

SUMMARY OF THE INVENTION

The present invention provides for a bracket for attaching bridging members to a thermal stud being generally C-shaped with parallel spaced apart flanges connected by a central web having openings in the web of the stud which span the majority of the width of the web and wherein the openings are provided with flanges extending perpendicularly from the edges of the opening into the interior of the stud. The bracket is a generally L-shaped bracket having a leg for overlying and for attachment to and with a means to properly locate a bridging member centrally within the stud wall and a base for overlying the web of the stud. The base has a width approximately the same as the stud and is capable of being attached to the web of the stud. The base is also provided with a centrally located tab extending perpendicularly from the base to allow the bracket to be properly positioned against an edge of the opening within the web of the stud.

In an aspect of the invention, the base has flanges extending perpendicularly from the base at either end thereof to engage and be able to be attached to the flanges of the stud.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
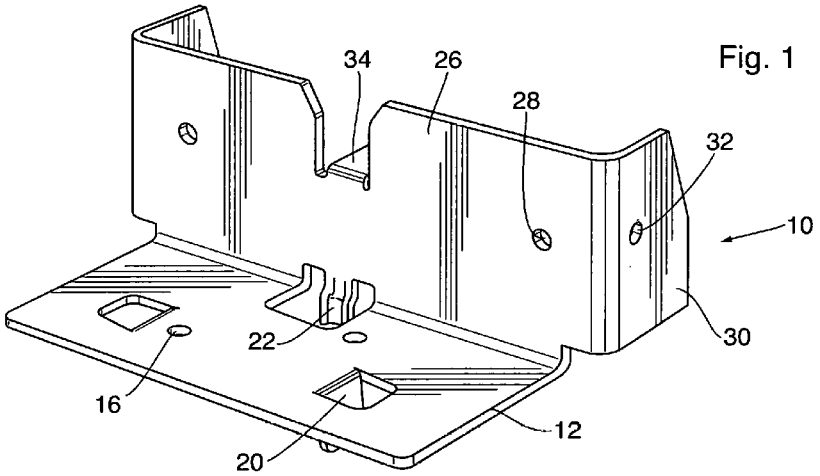
FIG. 1 is a perspective view of a preferred embodiment of the bracket of the present invention.
Figure 2:
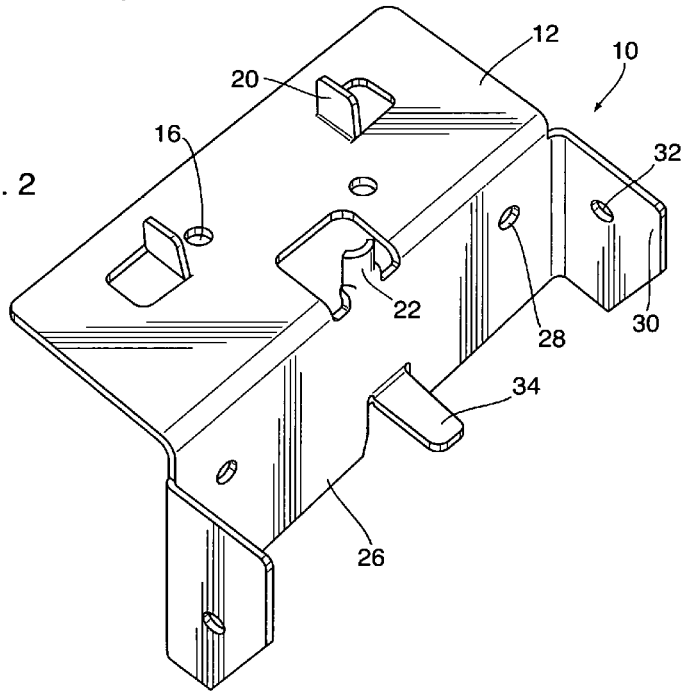
FIG. 2 is a rear perspective view of the bracket of FIG. 1.
Figure 3:
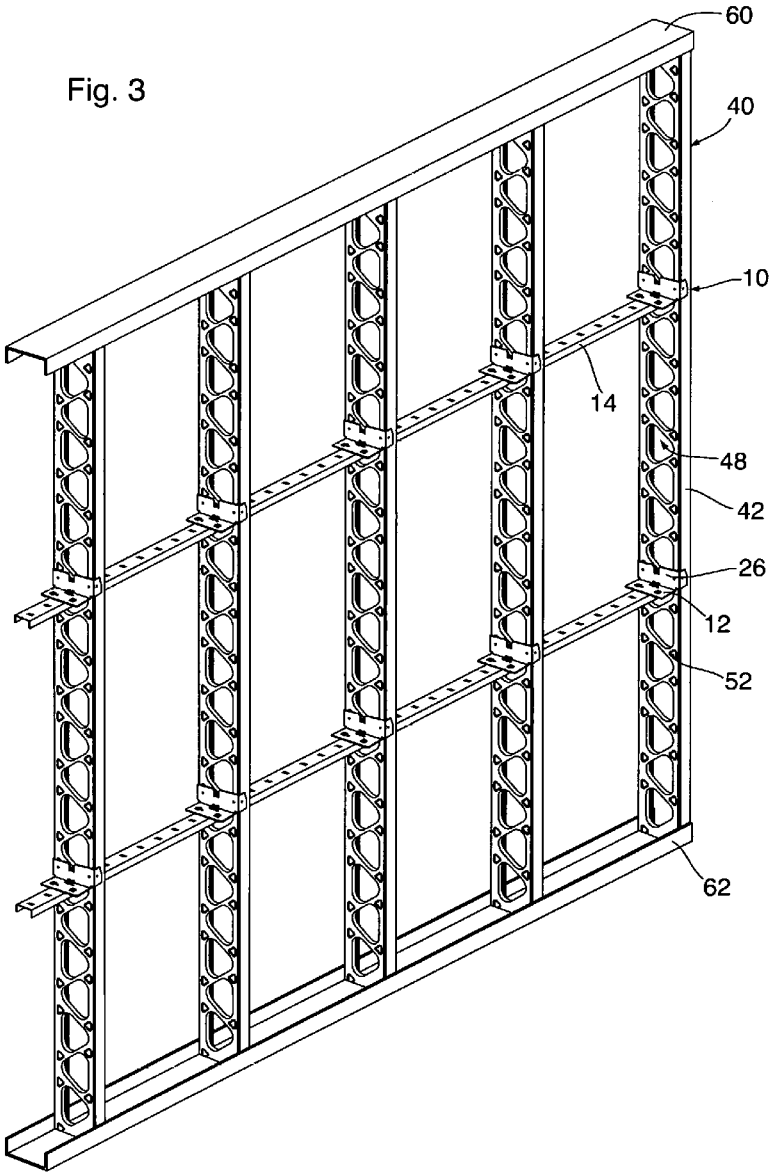
FIG. 3 is a perspective view of a stud wall of thermal studs utilizing the bracket of the present invention.
Figure 4:
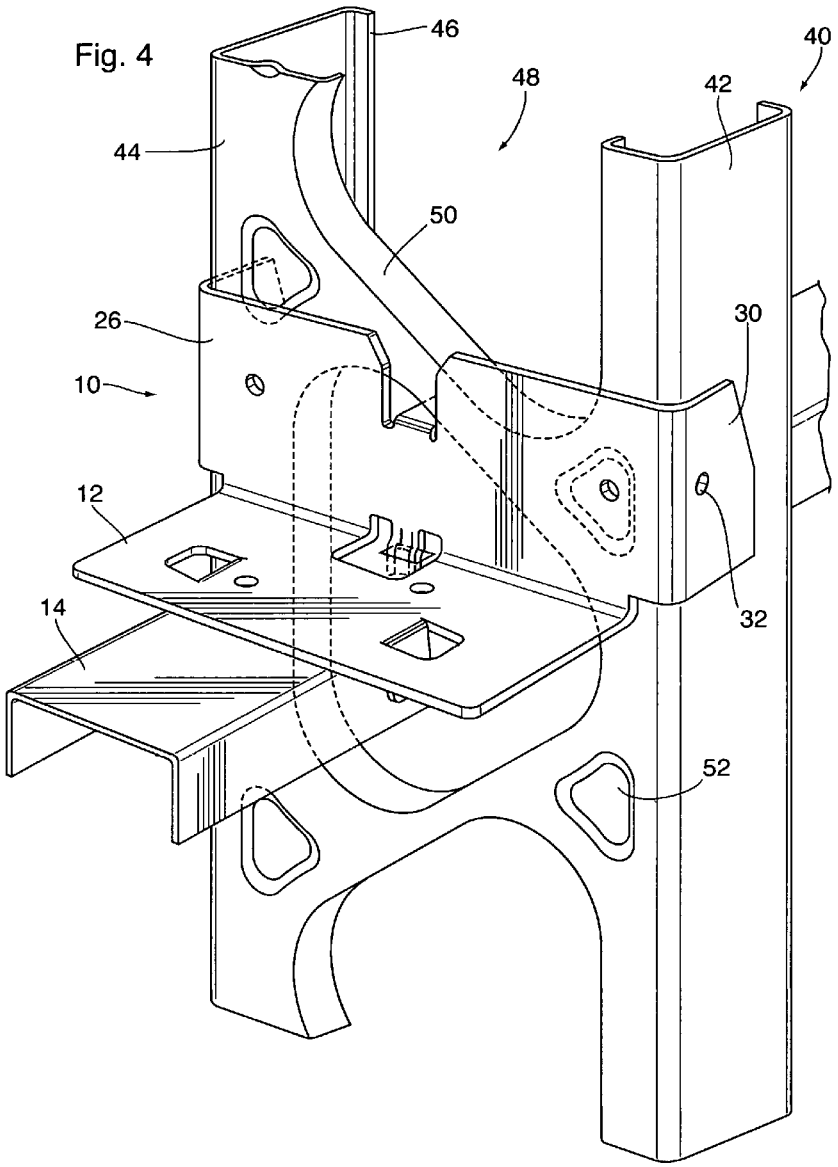
FIG. 4 is a perspective view of the bracket of FIG. 1 placed on the thermal stud with the bridging member attached thereto.

The bracket of the present invention is for use with thermal studs such as those illustrated in Canadian Patent 1,324,872 or 2,404,320. Such thermal studs typically are metal studs being generally C-shaped with spaced apart parallel flanges extending the length of the stud with the flanges being interconnected by a central web. In order to provide for the thermal break, the central web is provided with a plurality of openings which typically are generally triangular in shape. In order to provide for stiffening of the web, internally turned flanges are provided at the edges of the openings in the web the flanges extending into the interior of the stud as defined by the web and parallel spaced apart flanges. These features are shown in FIGS. 3 and 4 as set out below.

A preferred embodiment of the bracket of the present invention is illustrated in the drawings generally indicated by the numeral 10. The bracket 10 has a leg 12 which projects outwardly from the bracket to allow for attachment to a bridging member 14 as will be illustrated in the following drawings. The leg 12 is provided with openings 16 to allow for fastening means such as screws 18 to be placed through the openings 16 and into the bridging member 14 to attach the bridging member 14 to the bracket 10. Preferably, in order to properly locate the bridging member 14 centrally within the bracket 10 and the web of the stud, tabs 20 are struck out of the leg 12 such that they extend downwardly perpendicularly from the leg 12 and hold the bridging member 14 in the space between the tabs 20. In order to provide for proper spacing of the studs within the stud wall, the bracket 10 may be provided with downwardly extending tabs 22 to engage with openings 24 in the bridging member as has been described in commonly owned U.S. patent application Ser. No. 11/352,335, the disclosure of which is incorporated herein by reference.

The bracket 10 is also provided with a base 26 for overlying the web of the stud. Base 26 is provided with openings 28 spaced to allow fastening means 18 to pass through the openings 28 and engage with the web of the stud. Preferably, to increase the support of the bracket 10, at either end of the base 26 extension flanges 30 are provided which wrap around and engage with the flanges of the stud to properly position the bracket 10 centrally within the stud. Openings 32 may be provided in the extension to allow fastening means to be passed therethrough and engage with the flange of the stud.

In order to properly space the bracket 10 longitudinally on the stud, the base 26 is provided with a tab 34 struck out of the base and extending perpendicular thereto to engage the edge of the opening of the web of the stud, preferably at the top of the opening as will be described below. In this way the brackets 10 are properly placed longitudinally on the stud to engage the bridging member 14 and tie the bridging member 14 back to the stud of the stud wall.

As illustrated in FIGS. 3 and 4, the stud wall utilizes the thermal studs 40 as described above. The studs 40 have spaced apart parallel flanges 42 extending the length of the stud 40 with the flanges being interconnected by a central web 44. The edges of the flanges 42 opposite the web 44 are provided with inturned extensions 46 to give the stud 40 its generally C-shaped configuration. In order to provide for the thermal break of the stud 40 the central web 44 is provided with a plurality of openings 48 which typically are generally triangular in shape. In order to provide for stiffening of the web 44 the edges of the openings 48 are provided with internally inturned flanges 50 at the edges of the openings 48 in the web, the flanges 50 extending into the interior of the stud 40 as defined by the web 44 and parallel spaced apart flanges 42. Embossed indents 52 may also be provided in the web 44 to provide for further stiffening of the web particularly for load bearing applications. As illustrated in FIG. 3, in the construction of the stud wall, the studs 40 are installed in the conventional manner between top track 60 and bottom track 62 and thereafter the bridging member 14 is passed through the openings 48 of the studs 40 and then the brackets 10 are placed on each of the studs 40 with the base 26 overlying the web 44 of the stud 40 and the extensions 30 overlying the flanges 42 of the studs 40. Once the bridging members 14 and brackets 10 are properly aligned, the brackets 10 are first attached to the bridging members 14 by suitable fastening means 18 passing through the openings 16 of the leg of the bracket 10 and engaging the bridging member 14 and then the brackets 10 are attached to the web 44 and the flange 42 of the studs 40 by suitable fastening means 18 engaging the openings 28 and 32, respectively to attach to the bracket 10 to the web 44 and the flange 42 of the stud 40. In order to properly position the brackets 10 within the openings 48, the brackets 10 are moved upwardly prior to the attachment until the tab 34 engages the top of the opening 48 of the web 44 of the stud 40.

Figure 5:
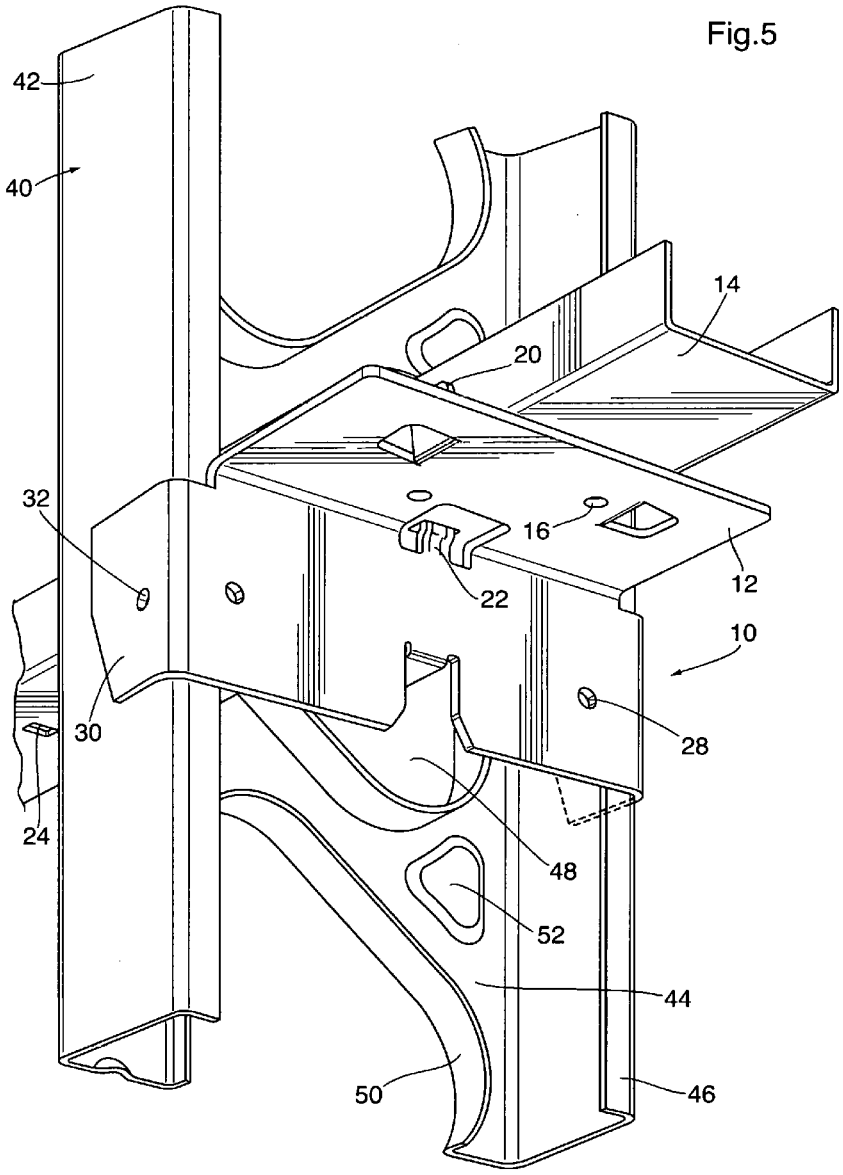
FIG. 5 is a perspective view of the bracket of FIG. 1 placed on the rear of the thermal stud.
Figure 6:
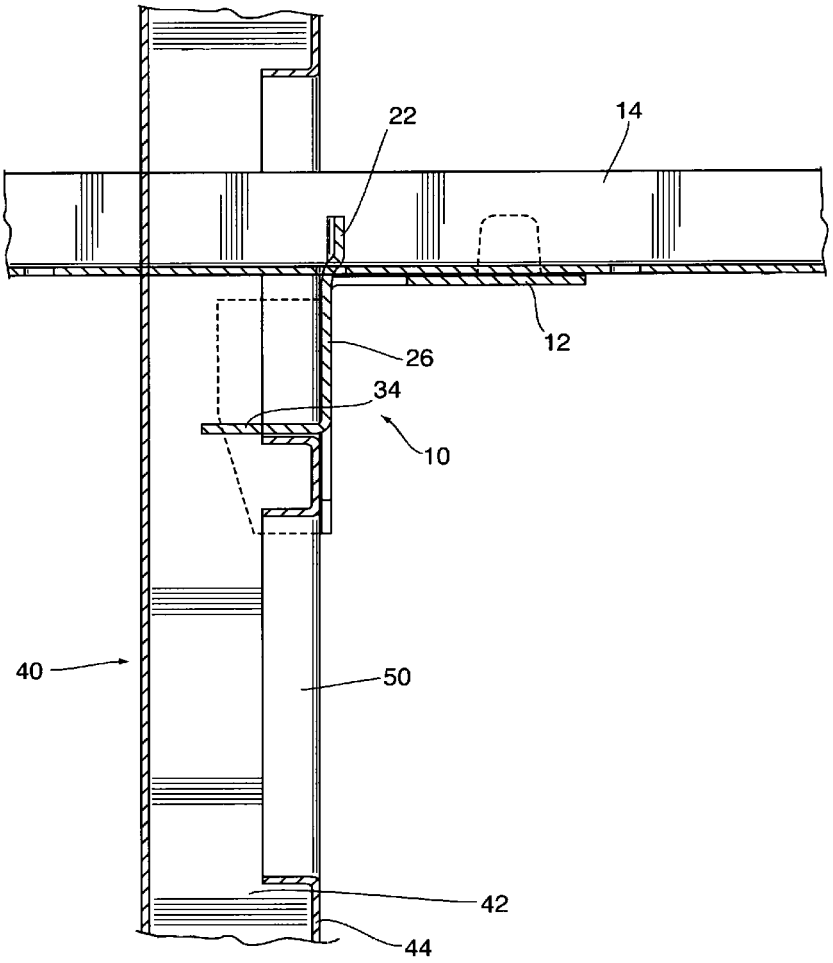
FIG. 6 is a side elevation view in cross-section of an alternate arrangement of the bracket on the stud.
Figure 7:
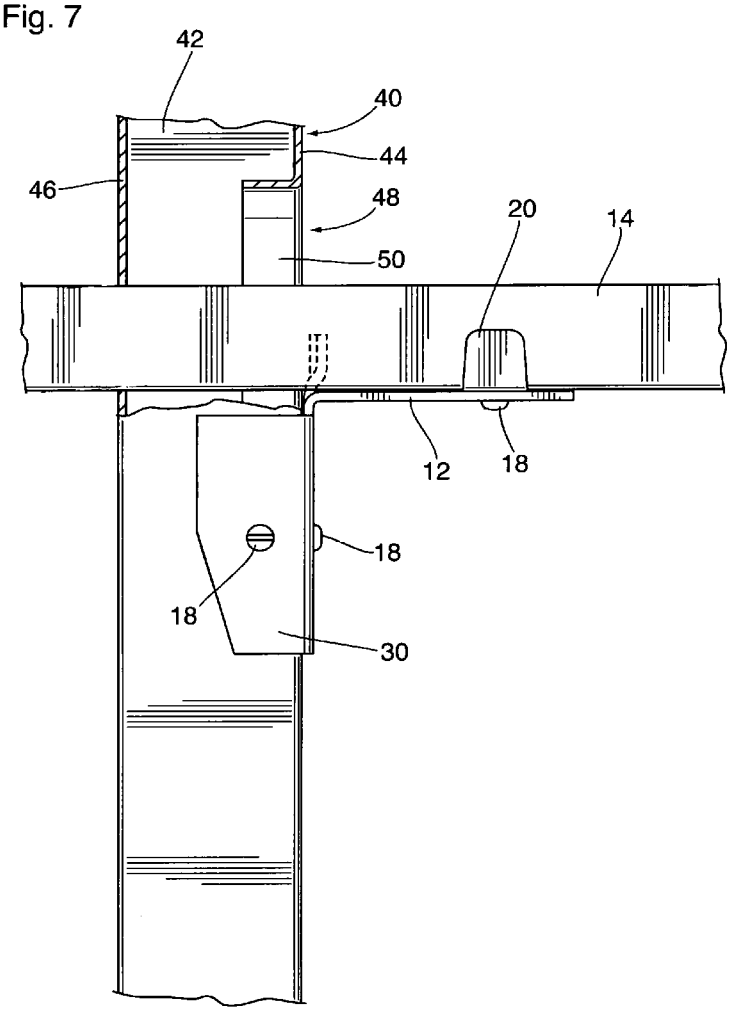
FIG. 7 is a side elevation view of the bracket placed in accordance with FIG. 5.

Alternative arrangements for mounting of the bridging member 14 and bracket 10 to the stud 40 are illustrated in FIGS. 5 to 7. In FIG. 5 the bracket 10 is mounted on the backside of the stud 40 and may also be mounted in an inverted configuration such that the base 26 is downwardly oriented and the bridging member 14 is arranged with its opening facing upwardly. This arrangement may be utilized where it is desired to have the bridging member pass through different parts of the openings 48 in the web 44 of the stud 40.

Another alternative arrangement is illustrated in FIGS. 6 and 7 in which the bracket 10 is mounted such that the base 26 is downwardly oriented and positioned such that the tab 34 on the base 26 engages the lower edge of the openings 48 in the web of the stud 40.

The bracket of the present invention allows for simple and rapid attachment of bridging members to thermal studs having openings in the web of the stud which span the majority of the width of the web to provide for the break of thermal conductivity across the web of the stud. The brackets allow for proper positioning of the bridging members within the stud wall as well as providing for proper securement of the bridging member to the stud to adequately transfer the support provided by the internal bridging members to the metal stud to provide for resistance to rotation or minor axis bending of the studs in the stud wall under wind and axial loads.

Although various preferred embodiments of the present invention have been described herein in detail, it will be appreciated by those of skill in the art that variations may be made thereto and all such variations are included within the scope of the present invention.

We claim:

1. A bracket for attaching bridging members to a thermal stud being generally C-shaped with parallel spaced apart stud flanges connected by a central web having openings in the central web of the thermal stud which spans a majority of the width of the central web and wherein the openings are provided with opening flanges extending perpendicularly from the edges of the openings into an interior of the stud, the bracket comprising a generally L-shaped metal member having a leg with a downwardly extending tab to locate a bridging member centrally within the bracket and one opening of the central web of the thermal stud and a base for overlying the central web of the thermal stud and being attachable thereto, the base having a width approximately the same as the width of the thermal stud, the base being also provided with a centrally located base tab extending perpendicularly from the base to engage the opening flange extending from the edge of the one opening of the central web to allow the bracket to be positioned against the one opening of the central web of the thermal stud.

2. A bracket for attaching bridging members to a thermal stud according to claim 1 wherein the bracket has bracket flanges extending perpendicularly from the base at either end thereof to engage and being attachable to the stud flanges of the thermal stud.

3. A bracket for attaching bridging members to a thermal stud according to claim 2 wherein said a downwardly extending tab is adapted to engage with an opening in the bridging member to locate the bridging member centrally within the bracket and the opening of the thermal stud.

4. A thermal stud wall comprising a plurality of parallel spaced apart vertical thermal studs attached to bottom and top tracks and interconnected by a bridging member, each of the thermal studs being generally C-shaped with parallel spaced apart stud flanges connected by a central web having openings in the central web of the thermal stud which spans a majority of the width of the central web and wherein the openings are with opening flanges extending perpendicularly from the edges of the openings into an interior of the stud, the bridging member being a generally U shaped metal member passing through aligned openings of the central webs of the thermal studs and being connected to each central web of the spaced apart thermal studs by a bracket, the bracket being a generally L-shaped metal member having a leg to overlie and be attached to the bridging member centrally within the bracket and one opening of one thermal stud and a base for overlying the central web of the one thermal stud and being attached thereto, the base having a width approximately the same as the width of the one thermal stud, the base being also provided with a centrally located base tab extending perpendicularly from the base to engage the opening flange extending from the edge of the opening of the central web to allow the bracket to be positioned against the opening of the central web of the one thermal stud.

5. A thermal stud wall according to claim 4 wherein the bracket has bracket flanges extending perpendicularly from the base at either end thereof to engage and being attached to the stud flanges of the one thermal stud.

6. A thermal stud wall according to claim 5 wherein the leg of the bracket has a downwardly extending tab to engage with an opening in the bridging member to locate the bridging member centrally within the bracket and the openings of the one thermal stud.

* * * * *